US006811654B1

(12) United States Patent
Kytönen et al.

(10) Patent No.: US 6,811,654 B1
(45) Date of Patent: Nov. 2, 2004

(54) METHOD AND ARRANGEMENT FOR CALENDERING PAPER AND BOARD BEFORE AND AFTER COATING

(75) Inventors: Pauli Kytönen, Riihikallio (FI); Mikko Tani, Appleton, WI (US)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/720,550

(22) PCT Filed: Jun. 24, 1999

(86) PCT No.: PCT/FI99/00563

§ 371 (c)(1),
(2), (4) Date: Jan. 3, 2001

(87) PCT Pub. No.: WO99/67462

PCT Pub. Date: Dec. 29, 1999

(30) Foreign Application Priority Data

Jun. 25, 1998 (FI) ..... 981467

(51) Int. Cl.[7] ..... D21F 11/00

(52) U.S. Cl. ..... 162/206; 162/358.3; 162/358.4; 162/358.5; 162/361; 162/135; 162/136; 162/205; 100/153; 100/93 RP

(58) Field of Search ..... 162/206, 205, 162/207, 358.3, 358.4, 358.5, 361, 135, 136; 100/153, 93 RP, 173

(56) References Cited

U.S. PATENT DOCUMENTS

| | | | | |
|---|---|---|---|---|
| 5,163,364 | A | | 11/1992 | Bubik et al. |
| 5,483,873 | A | | 1/1996 | Koivukunnas et al. |
| 5,582,689 | A | | 12/1996 | Van Haag et al. |
| 5,938,895 | A | * | 8/1999 | Hirvonen ..... 162/205 |

FOREIGN PATENT DOCUMENTS

| | | |
|---|---|---|
| WO | WO 95/34715 | 12/1995 |
| WO | WO 96/28609 | 9/1996 |
| WO | WO 97/13035 | 4/1997 |

* cited by examiner

*Primary Examiner*—Peter Chin
*Assistant Examiner*—Mark Halpern
(74) *Attorney, Agent, or Firm*—Cohen, Pontani, Lieberman & Pavane

(57) ABSTRACT

A method and apparatus for calendering paper or board in the manufacture of coated grades of paper or board. At least one of the surfaces of an uncoated base material web is calendered, at least one layer of coating mix being applied onto said surface, and at least the coated surface of the base web is calendered again. The uncoated surface of the base web is calendered by means of a shoe calender having a nip length of at least 50 mm, and the coated surface of the base web is calendered by means of a calender having a nip length of 50 mm at the most.

21 Claims, No Drawings

METHOD AND ARRANGEMENT FOR CALENDERING PAPER AND BOARD BEFORE AND AFTER COATING

PRIORITY CLAIM

This is a national stage of PCT application No. PCT/FI99/00563, filed on Jun. 24, 1999. Priority is claimed on that application, and on patent application No. 981467 filed in Finland on Jun. 25, 1998.

FIELD OF THE INVENTION

The present invention concerns a method and the apparatus for calendering paper and board in the manufacture of coated grades of paper or board.

BACKGROUND OF THE INVENTION

Paper or board is calendered in order to improve its printability properties. Calendering increases the smoothness and glare of the surface, and in addition, it affects the thickness and bulk ($cm^3/g$) of the material. Changes other than those affecting the surface are usually unintentional, because changes in material thickness are not desired. The unavoidable change in bulk must be adapted to the desired surface quality such that the desired surface quality and bulk as well as the desired final material thickness are obtained. Uncoated material can be subjected to calendering prior to the coating step, or the calendering may be carried out after coating, or at several steps. Many types of calendering methods and apparatuses are available, whereof machine calenders, softcalenders and supercalenders may be mentioned, and as the most recent type of calenders, shoe calenders and belt calenders may be cited. Each type of calender has its individual effect on the quality of the produced material, as well as its own typical field of application. The different types of calenders and their use are well known in the manufacture of paper and board.

European patent No. 0 370 185 describes a typical shoe calender comprising a backing roll and an arched shoe-like stop designed to encircle part of the roll surface. An endless belt travels around the shoe and is fitted to move at the same speed as the material being treated. The material to be calendered travels between the belt and the backing roll and is glazed against the surface of the backing roll. The backing roll can be heated and deformations of the surface occur due to the press power of the shoe and the backing roll, and due to heat. The glazing result is naturally also affected by the wetness of the web. The shoe calender provides a number of advantages, such as the fact that due to the longer dwell time, a smaller compression load and possibly temperature may be used than in roll calenders, still achieving a similar end result. Due to the reduced nip pressure a smaller contraction of the calendered web is achieved, thus preserving a greater part of the original stiffness, or bulk, of the web.

A shoe calender usually provides better glare than the corresponding softcalender.

The German Patent Application No. DE 43 22 876 describes a shoe calender with a smaller shoe width and thus also a shorter glazing zone than in the above-cited solution. In this calender, two calendering nips can be fitted against the same backing roll, and the strap surrounding the shoe is similar to the roll jacket. In German Patent publication No. DE 44 10 129, a shoe calender is described where the shoe is divided into two zones in the moving direction of the web being treated, the press power of the zones against the backing roll being adjustable independent of each other.

Belt calenders, in which the calender zone is provided by a roll and a belt pressed against said roll by means of a second roll, bear a close resemblance to shoe calenders. The belt may be flexible in the direction of its thickness, whereby a pressure treatment zone defined by the properties of the belt and the geometry and loading force of the calender rolls used will be provided between the backing roll and the belt. Also a calender having a very short pressing shoe is termed a belt calender, whereby the length of the nip almost corresponds to a nip formed with two rolls.

Long-nip calenders, belt calenders and softcalenders are well suited for calendering board. In PCT patent publication No. WO 96/28609, a coated packing board is described, whose manufacturing process involves the use of a lengthened soft calender nip. The board is calendered after coating. By calendering, a sufficiently good printing surface is obtained, and due to the lengthened nip, a lower pressure may be applied during calendering, whereby a smaller reduction in density and basis weight is achieved. This is of particular advantage in the manufacture of packing board because a lighter board provides greater flexural strength. The length of the lengthened nip of the calender used is reported as being from 30 to 100 mm, preferably 60 to 70 mm. Thus, the calender used is still one having a fairly short nip. The web speed and dwell time used are not reported.

In PCT patent publication No. WO 97/44524, a method for manufacturing LWC paper is described. This publication makes clear the considerable effect of the treatment temperature on the properties of the paper being manufactured. According to the publication, coated paper is calendered in a soft calender and the temperature of the paper is kept below the softening temperature of lignin. According to the publication, the method achieves much better glare than previously known methods involving the use of a softcalender.

SUMMARY OF THE INVENTION

The present invention aims at providing a method for manufacturing precalendered and end-calendered coated paper or board.

The invention is based on first calendering the material to be treated in a long-nip calender, and after coating, in a calender having a short nip.

The invention achieves considerable benefits.

Paper and board which consist of plant fibers behave in different ways during calendering when uncoated and when coated. In addition, the calendering is essentially affected by the moisture content of the material, wherefore calendering is usually accompanied by moisture control of the treated material. By means of the invention, these material properties can be exploited, thereby achieving paper and especially board having better printability and strength properties than previously obtained. As regards board and also the thickest grades of paper, a change in density during calendering essentially affects the strength properties of the material in the above-described manner, wherefore it is of particular advantage to be able to control the calendering process during the different manufacturing steps in accordance with the material properties when producing these materials.

DETAILED DESCRIPTION OF THE PRESENTLY PREFERRED EMBODIMENTS

In the following, the solution of the invention is explained in the context of board manufacture, which is what the invention is particularly well suited for. The invention is also applicable to a similar treatment of a paper web.

During calendering, the demands of the process vary according to whether the web being treated is coated or whether uncoated material is being treated. This is due to the different behaviour of the fibers constituting the material (usually fibers derived from wood), and the coat, by the action of the thermomechanical stress affecting them during a calendering. Thus, different demands are made on the calender and the process at the different stages of the treatment of the web, and it is of advantage to use a different method of calendering at the precalendering stage than is used for the final calendering after coating. Uncoated board mainly contains raw materials such as cellulose, hemicellulose and lignin, contained in wood or other fibrous raw material. These have the structure of polymers having markedly higher a glass transition temperatures than the polymers contained in the coating. On the other hand, the base board consists' of crossing fibers which can hardly move at all in relation to each other, whereas the coating consists of binders and small particles which move relatively easily in relation to each other and on the base board when compared to fibers. Thus, uncoated board requires longer treatment times and higher thermomechanical stress before permanent deformations of the fibers are achieved. The coating layer, on the other hand, moves fairly easily on the surface of the base board when compared to fibers, and thus, shorter treatment times can be used when processing the surface of coated board.

In the process of the invention for manufacturing coated board or paper, the web is finished by calendering at least such that the calendering which takes place prior to the coating step, i.e. the so called pre-calendering, is performed in a long-nip calender where the web is taken to a pressing zone formed by the belt and the backing roll, the fibers forming said web being subjected to a treatment in said zone during which the pressure in the treatment zone rises to 15 MPa at the most and the temperature of the web surface part reaches at least the glass transition temperature of the cellulose fibers.

The maximum pressure in the treatment zone is kept at 0 to 15 MPa, preferably, however, at 4 to 12 MPa. The web is taken to the treatment zone at a moisture content and temperature where at least the glass transition temperature of the material forming its surface part has been reached, the web thus having good workability properties. The glass transition temperature can be reached either by taking the web to the calendering by means of a pretreatment, such as steaming and/or wetting with water, or the conditions in the calendering zone are adjusted such that the preconditions for working the web are met in the calendering zone. Here, it is possible to use, e.g., the combination of prewetting and a heated backing roll.

Thus, the calendering zone is mainly characterized by being formed between the belt and the stop surface for calendering arranged opposite the belt, and in that a pressure affecting the web prevails inside the calendering zone, its intensity varying from 0 to 15 MPa. The lower limit of the pressure range is reached, for example, such that the calendering zone is formed between at least two belts stretched by belt guiding means, and a stop surface, and the upper limit, e,g., by so called shoe calender technology. In addition, it is characteristic of the calendering zone that the dwell time of the web in the calendering zone is at least 3 ms, while, however, it is 40 ms at the most, which at web speeds of 400 to 1000 m/min corresponds to calendering zone lengths of 50 to 270 mm.

A web thus precalendered, then, is characterized by good surface smoothness while its flexural strength remains almost at its initial level. When the web surface is smooth and sealed prior to the coating step, the amount of coating mix applied can be essentially reduced or, correspondingly, the printability of the end product can be improved, even to a level exceeding that described in PCT patent publication No. WO 96/28609 without losing the flexural strength or "bulkiness" of the web.

In the case of a long-nip calender, the dwell time in the nip (the nip time) can be optimized without changing the other process conditions. In the present context, a long-nip calender is a machine having a nip length exceeding 50 mm. "Nip length" is the length over which, the treated web is subjected to a pressing influence. Nip pressure may vary over the length of the nip, e.g., such that the nip, is divided, e.g., by dividing the pressing shoe into sectors in the travelling direction of the web, the press power of the sectors towards the backing roll being independently controllable. Such a construction also makes it possible to alter the nip length stepwise by removing the press power of the outermost sectors. Nip length is selected according to the desired calendering effect. In the solution of the present invention, an uncoated paper or board web is treated with a calender having a nip length of 50 to 270 mm. When applying a speed of 800 to 1000 m/min, common in board manufacture, a nip time of 3 to 20 ms is thus obtained.

In the case of belt calenders, on the other hand, markedly greater forces in the surface direction have been found to occur than is the case for softcalenders. Thus, they will provide an advantageous effect on quality especially in the manufacture of coated board and corresponding products, whereby the aim during the final calendering step is to move the coating mix on the surface of the base web and to align the coating mix particles. Such alignment is achieved by means of a belt calender supported by a backing roll or by a shoe calender having a very short shoe. The length of the shoe should not exceed 50 mm.

The result of the calendering can also be affected by the material of the backing roll, in other words, by using a soft or a hard backing roll. The material of the backing roll is selected in accordance with the type of nip, the belt material, and the requirements set by the manufactured product. The invention can be applied to both on-line and off-line machines.

Usually, board and paper are coated in the same fashion on both sides, but, e.g., when manufacturing packing board, it may be necessary to coat only one side of the web or to prepare a different coat for each side of the web. In such a case it is possible to perform the calendering differently for the different sides of the web. Usually, heated rolls are used in calendering in order to produce a thermomechanical impact, but in some cases even cold rolls may be used at least for treating one of the sides of the web. An advantage provided by shoe calenders is that the web may be taken to the calender in a considerably wet state. This is beneficial particularly in on-line machines.

Thus, while there have been shown and described and pointed out fundamental novel features of the present invention as applied to a preferred embodiment thereof, it will be understood that various omissions and substitutions and changes in the form and details of the devices described, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A method for a calendering paper and board web when manufacturing coated grades of paper or board comprising:

calendering at least one of the surfaces of an uncoated base web with a shoe calender having a nip length of at least 50 mm to form at least one calendered surface;

applying at least one layer of coating at least onto the at least one calendered surface of the base web to form at least one coated surface; and calendering the at least one coated surface of the base web with a calender having a nip length of less than and not equal to 30 mm.

2. The method of claim 1, wherein an uncoated surface of the base web is calendered with a shoe calender having a nip length of 50 to 270 mm.

3. The method of claim 2, wherein pressure applied to the uncoated surface of the base web by the shoe calender is from 4 to 12 MPa.

4. The method of claim 2, wherein pressure applied to the uncoated surface of the base web by the shoe calender is from 0 to 15 MPa.

5. The method of claim 4, further comprising heating the base web such that surface fibers thereof are at at least a glass transition temperature when the base web enters the shoe calender.

6. The method of claim 5, wherein the base web is heated with the aid of one of the group consisting of pre-wetting, pre-steaming and heating the web with a heated backing roll.

7. The method of claim 1, wherein the at least one coated surface of the base web is calendered with a belt calender having a nip formed between two rolls.

8. The method of claim 7, wherein an uncoated surface of the base web is calendered with a shoe calender having a shoe divided into sectors in a travel direction of the web, a compression load of the sectors being independently controllable.

9. The method of claim 1, wherein the at least one coated surface of the base web is calendered with a belt calender having a nip formed by means of a short shoe.

10. The method of claim 9, wherein an uncoated surface of the base, web is calendered with a shoe calender having a shoe divided into sectors in a travel direction of the web, a compression load of the sectors being independently controllable.

11. The method of claim 1, wherein the uncoated surface of the base web is calendered with a shoe calender having a shoe divided into sectors in a travel direction of the base web, a compression load of the sectors being independently controllable.

12. The method of claim 1, further comprising heating the base web such that surface fibers thereof are at at least a glass transition temperature when the base web enters the shoe calender.

13. The method of claim 12, wherein the base web is heated with the aid of one of the group consisting of pre-wetting, pre-steaming and heating the web with a heated backing roll.

14. An apparatus for calendering a paper and board web when manufacturing coated grades of paper or board comprising:

a first calender for calendering at least one of the surfaces of an uncoated base web to form at least one calendered surface, the first calender comprising a shoe calender having a nip length of at least 50 mm;

a means for applying at least one layer of coating at least onto the at least one calendered surface of the base web to form at least one coated surface; and a second calender for calendering at least the at least one coated surface of the base web, the second calender having a nip length of less than and not equal to 30 mm.

15. The apparatus of claim 14, wherein the shoe calender has a nip length of 50 to 270 mm.

16. The apparatus of claim 15, wherein the shoe calender has a shoe divided into sectors in a travel direction of the web, a compression load of the sectors being independently controllable.

17. The apparatus of claim 14, wherein the second calender is a belt calender having a nip formed between two rolls.

18. The apparatus of claim 17, wherein the shoe calender has a shoe divided into sectors in a travel direction of the web, a compression load of the sectors being independently controllable.

19. The apparatus of claim 14, wherein the second calender is a belt calender having a nip formed by means of a short shoe.

20. The apparatus of claim 19, wherein the shoe calender has a shoe divided into sectors in a travel direction of the web, a compression load of the sectors being independently controllable.

21. The apparatus of claim 14, wherein the shoe calender has a shoe divided into sectors in a travel direction of the web, a compression load of the sectors being independently controllable.

* * * * *